US009784051B2

(12) United States Patent
Bergan

(10) Patent No.: US 9,784,051 B2
(45) Date of Patent: Oct. 10, 2017

(54) MOTION COMPENSATION SYSTEM

(71) Applicant: Cameron International Corporation, Houston, TX (US)

(72) Inventor: Håkon Bergan, Kristiansand (NO)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/114,957

(22) PCT Filed: Oct. 30, 2013

(86) PCT No.: PCT/US2013/067459
§ 371 (c)(1),
(2) Date: Oct. 31, 2013

(87) PCT Pub. No.: WO2015/002664
PCT Pub. Date: Jan. 8, 2015

(65) Prior Publication Data

US 2015/0008382 A1 Jan. 8, 2015

(30) Foreign Application Priority Data

Jul. 3, 2013 (NO) ..... 20130929

(51) Int. Cl.
*E21B 19/00* (2006.01)
*B63B 35/44* (2006.01)
(Continued)

(52) U.S. Cl.
CPC ..... *E21B 19/006* (2013.01); *B63B 35/4413* (2013.01); *B63B 39/00* (2013.01); *B66C 13/02* (2013.01)

(58) Field of Classification Search
CPC ..... E21B 19/09; E21B 19/006; B66C 13/02; Y10S 254/90
See application file for complete search history.

(56) References Cited

U.S. PATENT DOCUMENTS 2,187,439 A * 1/1940 Armstrong ..... B66D 1/48 114/268
2,187,714 A * 1/1940 Armstrong ..... B66C 13/02 212/272

(Continued)

FOREIGN PATENT DOCUMENTS

CN 101654145 B 6/2012
NL 7310417 A 1/1974

OTHER PUBLICATIONS

International Search Report dated Mar. 26, 2014 for PCT Application No. PCT/US2013/067459 filed Oct. 30, 2013.

(Continued)

*Primary Examiner* — Emmanuel M Marcelo
*Assistant Examiner* — Michael Gallion
(74) *Attorney, Agent, or Firm* — Chamberlain Hrdlicka

(57) ABSTRACT

A motion compensation system disposed on a structure of a drilling vessel. A stabilization assembly for use with the motion compensation system includes a first arm connectable to the structure, a first sheave connectable to the structure, a second arm connectable to the first arm, and a second sheave connectable to the second arm. At least one of the first arm and the first sheave are connectable to the structure at different locations and the first arm and the second sheave are connectable to the second arm at different locations.

18 Claims, 8 Drawing Sheets

(51) Int. Cl.
*B63B 39/00* (2006.01)
*B66C 13/02* (2006.01)

(56) References Cited

U.S. PATENT DOCUMENTS 3,001,396 A * 9/1961 Cleveland ..... E21B 47/0001 175/5
3,032,125 A * 5/1962 Hiser ..... E21B 17/01 166/341
3,549,129 A * 12/1970 Graham et al. ..... 114/245
3,788,074 A * 1/1974 Castela et al. ..... 60/413
3,791,628 A * 2/1974 Burns et al. ..... 254/277
3,881,695 A * 5/1975 Joubert ..... 166/355
3,977,531 A * 8/1976 Brewer ..... B66C 23/18 212/236
4,183,440 A * 1/1980 Wilkinson ..... B66C 23/701 212/231
4,421,173 A * 12/1983 Beakley ..... E21B 19/09 166/336
4,432,420 A * 2/1984 Gregory et al. ..... 166/355
4,469,171 A 9/1984 Mine
4,576,517 A * 3/1986 McCann ..... E21B 19/09 114/264
4,620,692 A * 11/1986 Foreman et al. ..... 254/277
4,688,764 A * 8/1987 Nayler et al. ..... 254/277
4,836,300 A 6/1989 Reed
4,886,397 A * 12/1989 Cherbonnier ..... 405/195.1
5,520,369 A * 5/1996 Chatard ..... 254/277
6,517,291 B1 * 2/2003 Pollack ..... B63B 35/4413 166/355
6,817,422 B2 * 11/2004 Jordan ..... E21B 19/006 166/355
6,901,818 B1 * 6/2005 Cheung ..... 73/862.393
6,926,260 B1 * 8/2005 De Groot ..... B66D 3/043 254/277
7,828,086 B2 * 11/2010 Lesko ..... 175/203
2005/0087731 A1 * 4/2005 Scott ..... 254/283
2010/0176079 A1 * 7/2010 Lucas et al. ..... 212/307
2014/0246203 A1 * 9/2014 Pohner ..... 166/355
2015/0008382 A1 * 1/2015 Bergan ..... 254/398

OTHER PUBLICATIONS

Norwegian Search Report dated Feb. 3, 2014 for Patent Application No. 20130929.
European Search Report dated Jan. 24, 2017 issued in corresponding application No. EP 13888756.7, 6 pgs.

* cited by examiner

MOTION COMPENSATION SYSTEM

BACKGROUND

The operations of many floating vessels, such as semi-submersible drilling rigs, drill ships, and pipe-laying ships, are impeded by sea swell. Sea waves impart an up-and-down motion to a vessel, commonly referred to as "heave," with the period of the waves ranging anywhere from a few seconds up to about 30 seconds or so and the amplitude of the waves ranges from a few centimeters or inches up to about 15 meters (about 50 feet) or more.

This up-and-down motion imparted to the vessel from the waves is then correspondingly imparted to any loads or structures attached to the vessel. In particular, this heave motion of the loads or structures extending from the vessel is often highly undesirable, and even dangerous, to equipment and personnel. For example, when attempting to drill a wellbore in the sea bed, the heave motion can cause a corresponding motion of the drill string. The up-and-down movement of a drill bit attached to the end of the drill string is highly undesirable and can severely restrict the operating window of the rig. For example, it has been estimated that in the North Sea, as much as 20% of rig operating time is lost "waiting on weather" when the sea would be calmer.

Heave compensation is directed to reducing the effect of this up-and-down motion on a load attached to the vessel. "Passive" heave compensation systems are typically used by fixing the load to a point, such as the sea bed. Sea swell may then cause the vessel to move relative to the load, in which a passive compensator uses compressed air to provide a low frequency dampening effect between the load and the vessel.

Further, "active" heave compensation systems may be used that typically involve measuring the movement of the vessel using a measuring device, such as a motion reference unit ("MRU"), and using a signal from the MRU that represents the motion of the vessel to compensate for the motion. The signal is used to control a drive, such as a drawworks, that moves a connection device, such as a traveling block or a crane hook, relative to the vessel. A drawworks may be used to control the connection device, in which the drawworks is a winch that is typically connected to the connection device by a cable that passes through a block and tackle arrangement. The drawworks can reel the cable in-and-out to cause the connection device to be raised and lowered relative to the vessel. The principle behind active heave compensation is to move the connection device in a manner equal to, but opposite, the heave motion of the vessel to cancel out the heave motion from being imparted to the load so that the desired motion of the load is achieved irrespective of the motion of the vessel.

Despite the advance in both passive and active heave compensation systems, however, heave compensation remains a priority to increase the safety and efficiency of drilling vessels.

BRIEF DESCRIPTION OF THE DRAWINGS

For a detailed description of the preferred embodiments of the invention, reference will now be made to the accompanying drawings in which.

DETAILED DESCRIPTION

Figure 1:
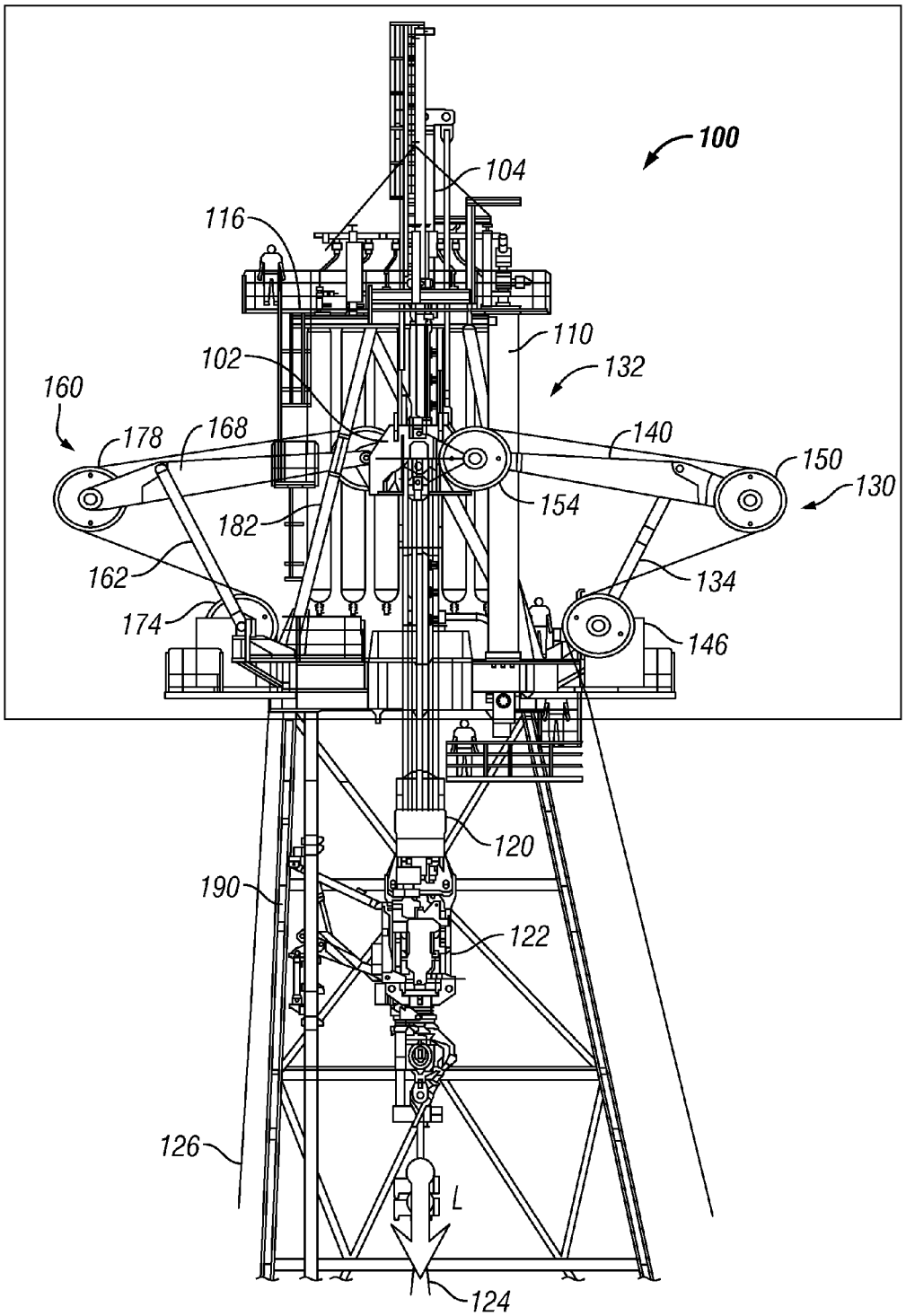
FIG. 1 shows a motion compensation system in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Referring now to FIG. 1, a motion compensation system 100 in accordance with one or more embodiments of the present disclosure is shown. The motion compensation system 100 may be disposed on a structure 190 of a drilling vessel (not shown), such as disposed on a deck of a derrick included on a drilling vessel. The motion compensation system 100 may include a crown block 102, with one or more compensator cylinders 104 coupled to the crown block 102. The motion compensation system 100 may further include an accumulator 110 fluidly coupled to the compensator cylinders 104 with one or more chambers 116 fluidly coupled to the accumulator 110. As used herein, "fluidly coupled" may refer to having multiple elements coupled to each other such that fluid (e.g., liquid or gas) may flow between the elements.

As the motion compensation system 100 may be disposed on a structure 190 of a drilling vessel, the motion compensation system 100 may be connected to the structure 190 and/or the drilling vessel. For example, referring still to FIG. 1, the crown block 102 may be coupled to a traveling block 120, such as by having a cable 126 extend between the crown block 102 and the traveling block 120. The cable 126 may be coupled between the crown block 102 and the traveling block 120, such as in a block and tackle arrangement.

A drive 122, such as a top drive, may be included within the structure 190 and connected to the traveling block 120, in which the drive 122 may be used to at least partially assist and move the traveling block 120 within the structure 190. Further, a drill string 124 may be connected to the traveling block 120, such as through the drive 122, in which a load L may be imparted to the drill string 124 using the traveling block 120 and/or the drive 122.

The motion compensation system 100 may further include a stabilization assembly 130 for use therewith, such as to assist the motion compensation system 100 when compensating for movement. For example, the stabilization assembly 130 may assist and/or stabilize movement of the crown block 102 and/or the traveling block 120. The stabilization assembly 130 may include rocker arm subassemblies 132 and/or 160, in which the rocker arm subassemblies 132 and 160 may each include one or more arms and/or one or more sheaves. As shown in FIG. 1, the rocker arm subassembly 132 may include a first arm 134 and a second arm 140, along with a first sheave 146, a second sheave 150, and/or a third sheave 154. Similarly, as shown in FIG. 1, the rocker arm subassembly 160 may include a first arm 162 and a second arm 168, along with a first sheave 174, a second sheave 178, and/or a third sheave 182.

The cable 126, which may be connected to a drawworks at one end and fixed at another end, such as fixed to a deck of a drilling vessel or some other point, may pass through the rocker arm subassembly 132, between the crown block 102 and the traveling block 120, and through the rocker arm subassembly 160. In particular, the cable 126 may pass and extend across opposing sides of the first sheave 146 and the second sheave 150 of the rocker arm subassembly 132, and may also pass and extend across opposing sides of the first sheave 174 and the second sheave 178 of the rocker arm subassembly 160. As such, the cable 126 may be adjusted, as desired, to control movement of the crown block 102 with respect to the traveling block 120 using the stabilization assembly 130 of the motion compensation system 100.

Figure 2:
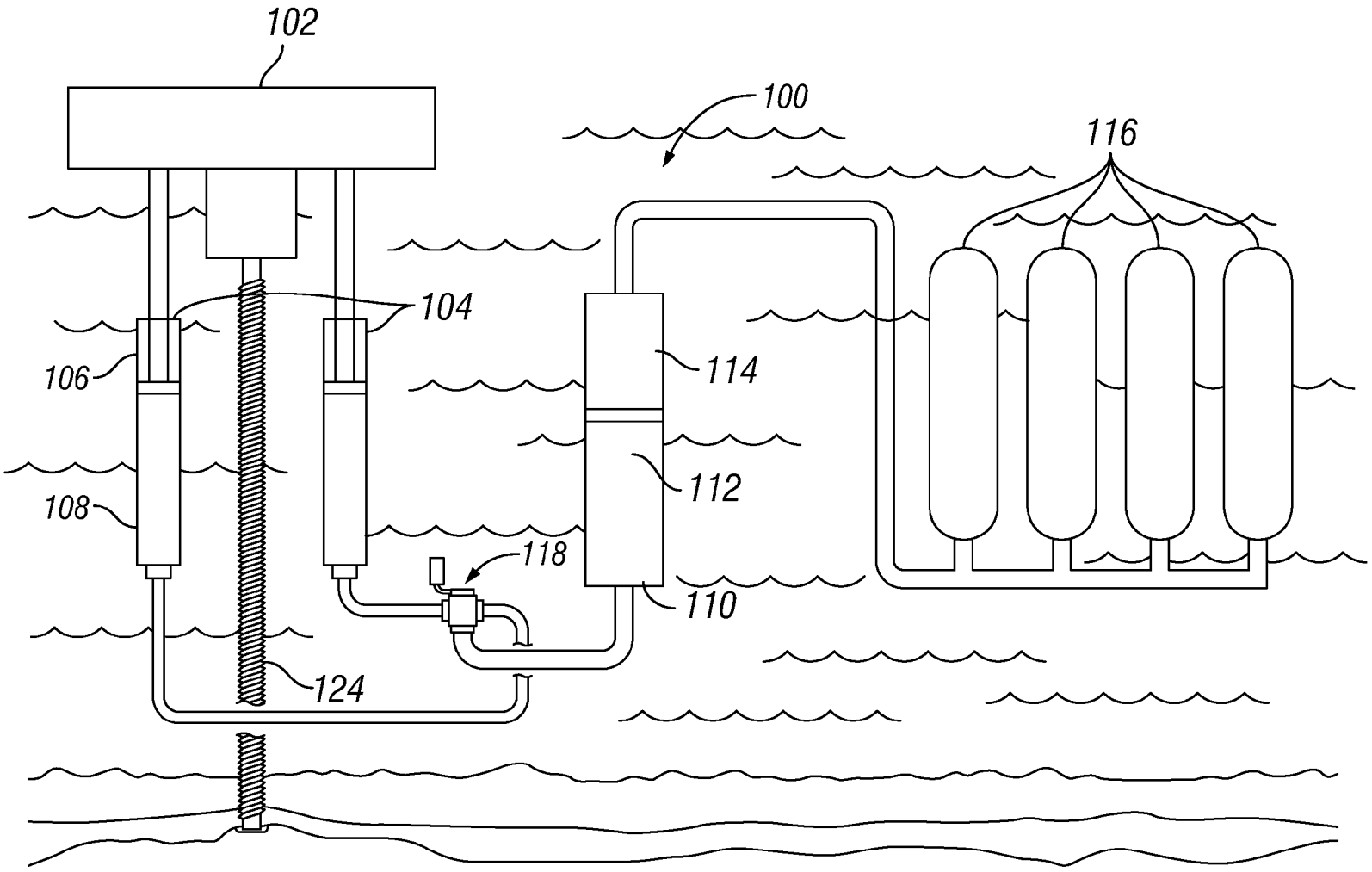
FIG. 2 shows a portion of a motion compensation system in accordance with one or more embodiments of the present disclosure.

Referring now to FIG. 2, a schematic drawing of a portion of the motion compensation system 100 in accordance with one or more embodiments of the present disclosure is shown moving between two positions. As discussed above, the motion compensation system 100 may include the crown block 102, the compensator cylinders 104, the accumulator 110, and the chambers 116. The crown block 102 may be coupled to the drill string 124, such as by having the crown block 102 coupled to the drill string 124 through the traveling block 120 and the drive 122 as shown in FIG. 1, and/or may include one or more other connection devices coupled therebetween.

Further, the crown block 102 may be coupled to the compensator cylinders 104, such as by having the crown block 102 connectable through a first side 106 of the compensator cylinders 104 with fluid (e.g., liquid) included on a second side 108 of the compensator cylinders 104. As the crown block 102 then moves, this movement may exert pressure on the second side 108 of the compensator cylinders 104 such that fluid may move between the compensator cylinders 104 and the accumulator 110 fluidly coupled thereto. In particular, fluid may pass between the second side 108 of the compensator cylinders 104 and a first side 112 of the accumulator 110. One or more valves 118, such as a motion compensator valve, a pilot valve, and/or a pilot accumulator, may be used to selectively control fluid flow between the compensator cylinders 104 and the accumulator 110.

As fluid passes into and out of the first side 112 of the accumulator 110, this movement may exert pressure on a second side 114 of the accumulator 110. Fluid, such as gas (e.g., air), may be included in the second side 114 of the accumulator 110, in which the gas may pass between the second side 114 of the accumulator 110 and the chambers 116 (e.g., air pressure vessels). As such, in one or more embodiments, liquid may be used as fluid in one portion of the motion compensation system 100, such as between the second side 108 of the compensator cylinders 104 and the first side 112 of the accumulator 110, and gas may be used as fluid in another portion of the motion compensation system 100, such as between the second side 114 of the accumulator 110 and the chambers 116. This arrangement may enable gas (e.g., air) within the motion compensation system 100 to provide a low frequency dampening effect as the crown block 102 moves.

Figure 3:
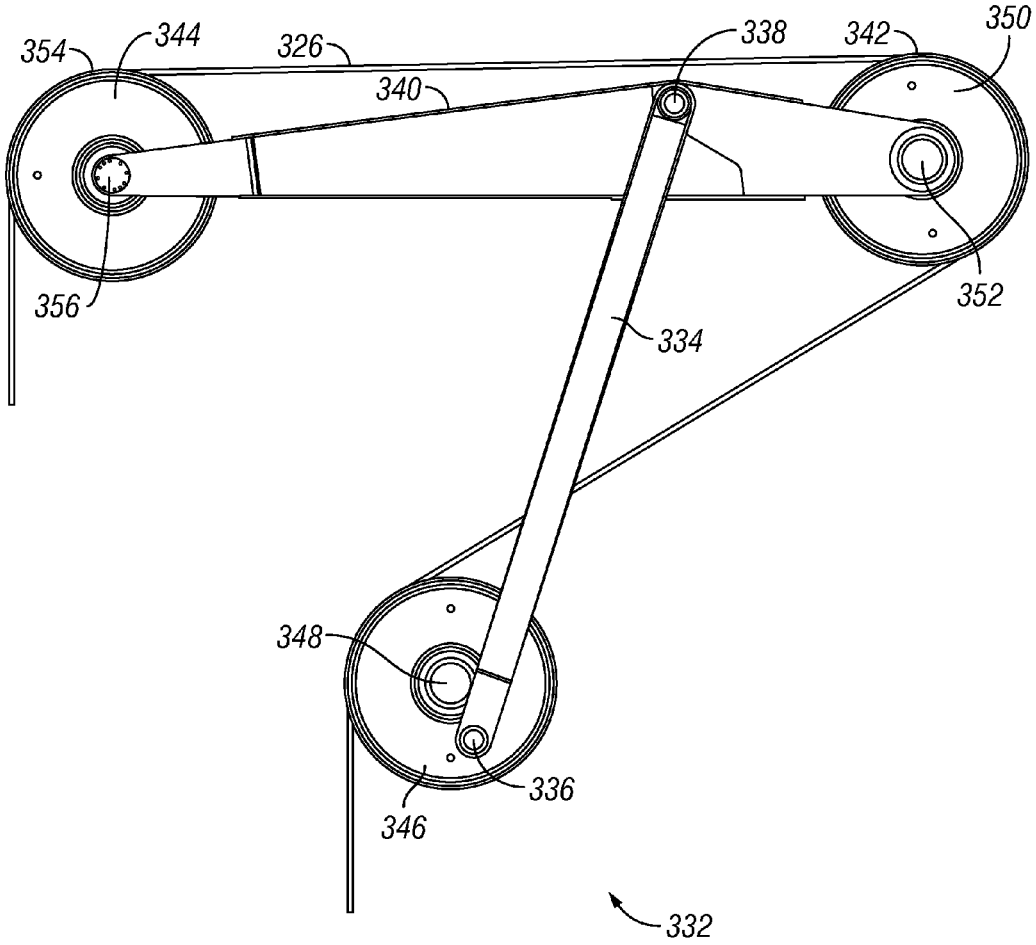
FIG. 3 shows a rocker arm subassembly of a motion compensation system in accordance with one or more embodiments of the present disclosure.

Referring now to FIG. 3, a rocker arm subassembly 332 of a motion compensation system in accordance with one or more embodiments of the present disclosure is shown. As discussed above, a motion compensation system may include a stabilization assembly with one or more subassemblies. As such, the rocker arm subassembly 332 may be used as an example of the one or more subassemblies included therein. The rocker arm subassembly 332 may include a first arm 334 connected to a second arm 340, such as by having the first arm 334 rotatably connected to the second arm 340. In this embodiment, the first arm 334 may have a first end 336 and a second end 338, in which the first end 336 may be connected, such as rotatably connected, to a structure (e.g., structure 126 in FIG. 1). For example, the first end 336 of the first arm 334 may be rotatably connected to a deck of a derrick disposed on a drilling vessel. Further, in this embodiment, the second end 338 of the first arm 334 may be connected, such as rotatably connected, to the second arm 340.

The rocker arm subassembly 332 may further include a first sheave 346 having an axis 348 and a second sheave 350 having an axis 352. The first sheave 346 may be connected, such as rotatably connected, to a structure (e.g., structure 126 in FIG. 1). For example, the first sheave 346 may be rotatably connected to a deck of a derrick disposed on a drilling vessel. As shown, the first sheave 346 may be disposed adjacent to the first end 336 of the first arm 334 when connected to the structure. However, the first sheave 346 and the first arm 334 may be connected to the structure at different locations. In particular, the first sheave 346 and the first arm 334 may be rotatably connected to the structure at different locations, such as by having the first sheave 346 and the first arm 334 rotatably connected to the structure about different axes. In this embodiment, the first sheave 346 may be rotatably connected to the structure about the axis 348, and the first arm 334 may be rotatably connected to the structure about the first end 336 thereof. As such, the connection between the first sheave 346 and the structure may be offset from the connection between the first arm 334 and the structure.

Further, the second sheave 350 may be connected, such as rotatably connected, to the second arm 340. For example, the second arm 340 may include a first end 342 and a second end 344, in which the axis 352 of the second sheave 350 may be rotatably connected to the first end 342 of the second arm 340. As shown, the second sheave 350 may be disposed in proximity to first arm 334 when connected to the second arm 340. However, the second sheave 350 and the first arm 334 may be connected to the second arm 340 at different locations. In particular, the second sheave 350 and the first arm 334 may be rotatably connected to the second arm 340 at different locations, such as by having the second sheave 346 and the first arm 334 rotatably connected to the second arm 340 about different axes. In this embodiment, the axis 348 of the second sheave 350 may be rotatably connected to the first end 342 of the second arm 340, and the first arm 334 may be rotatably connected to the second arm 340 about the second end 338 thereof. As such, the connection between the second sheave 350 and the second arm 340 may be offset from the connection between the first arm 334 and the second arm 340.

Referring still to FIG. 3, the rocker arm subassembly 332 may further include a third sheave 354 having an axis 356. The third sheave 354 may be connected, such as rotatably connected, to the second arm 340. For example, the axis 356 of the third sheave 354 may be rotatably connected to the second end 344 of the second arm 340. The third sheave 354 may then be connected, such as rotatably connected, to other components of the motion compensation system. For example, as shown in FIG. 1, the third sheave 154 may be rotatably connected to the crown block 102 of the motion compensation system 100. A cable 326 may then pass and extend across opposing sides of the first sheave 346 and the second sheave 350 with respect to each other, and may also pass and extend across opposing sides of the second sheave 350 and the third sheave 354 with respect to each other.

Figure 4:
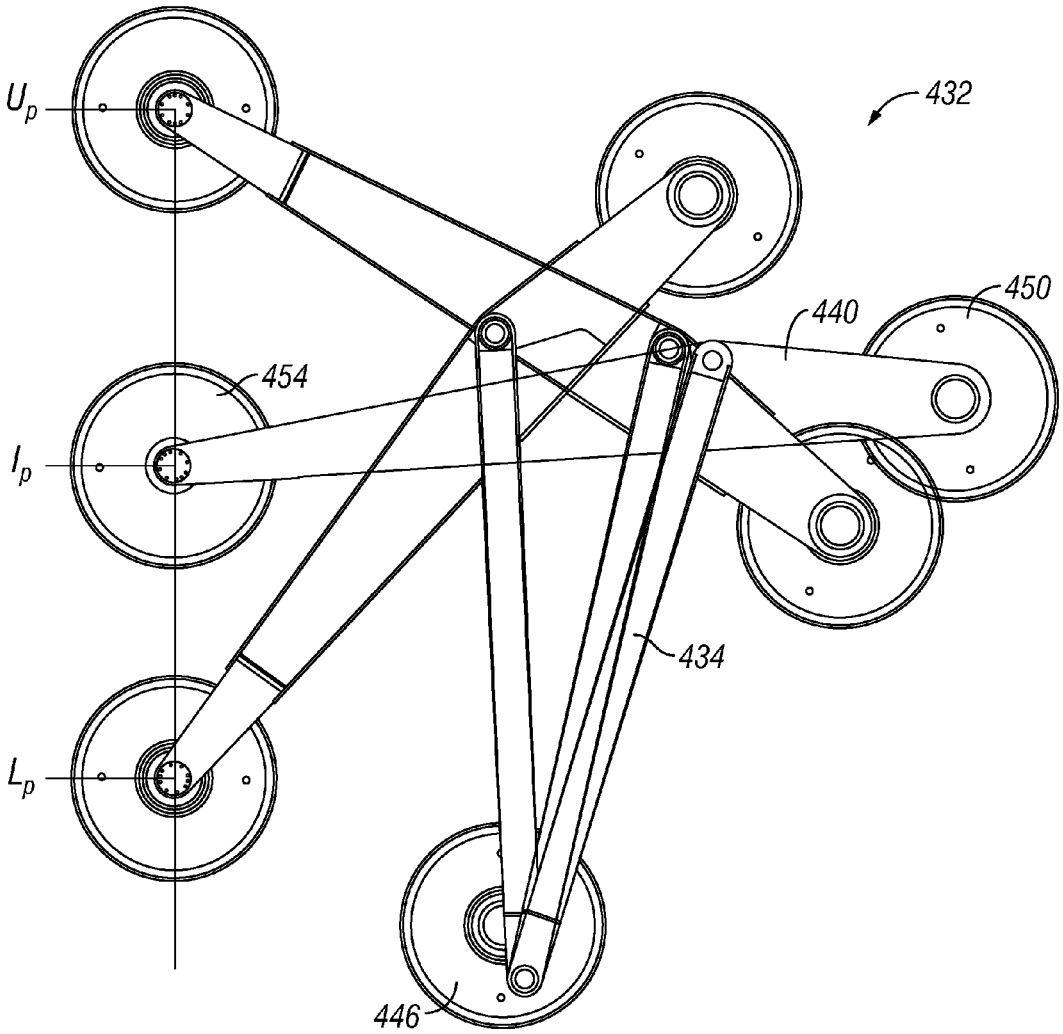
FIG. 4 shows a rocker arm subassembly of a motion compensation system in accordance with one or more embodiments of the present disclosure.

Referring now to FIG. 4, a rocker arm subassembly 432 of a motion compensation system in accordance with one or more embodiments of the present disclosure is shown. In particular, FIG. 4 shows the rocker arm subassembly 432 moving between an upper position $U_p$, an intermediate position $I_p$, and a lower position $L_p$. For example, as the rocker arm subassembly 432 may include the first arm 434 connected, such as rotatably connected, to the second arm 440, the first arm 434 and the second arm 440 may be movable with respect to each other between the upper position $U_p$, the intermediate position $I_p$, and the lower position $L_p$. Further, the first sheave 446, the second sheave 450, and/or the third sheave 454 may each be movable with respect to each other between the upper position $U_p$, the intermediate position $I_p$, and the lower position $L_p$. As such, as the third sheave 454 and/or the second arm 440 may be connected to a crown block (e.g., crown block 102), with the crown block movable between multiple positions when in use with a motion compensation system, the rocker arm subassembly 432 may be able to move along with the crown block between the upper position $U_p$, the intermediate position $I_p$, and the lower position $L_p$. As such, by including a rocker arm subassembly and/or stabilization assembly within a motion compensation system in accordance with one or more embodiments of the present disclosure, the motion compensation system may be able to reduce the force variation applied to a load, such as applied to a drill string and/or drill bit, and/or may be able to reduce variation of the relative distance of the cable between the crown block (e.g., crown block 102 in FIG. 1) and the traveling block (e.g., traveling block 120 in FIG. 1) when compensating for motion.

Figure 5:
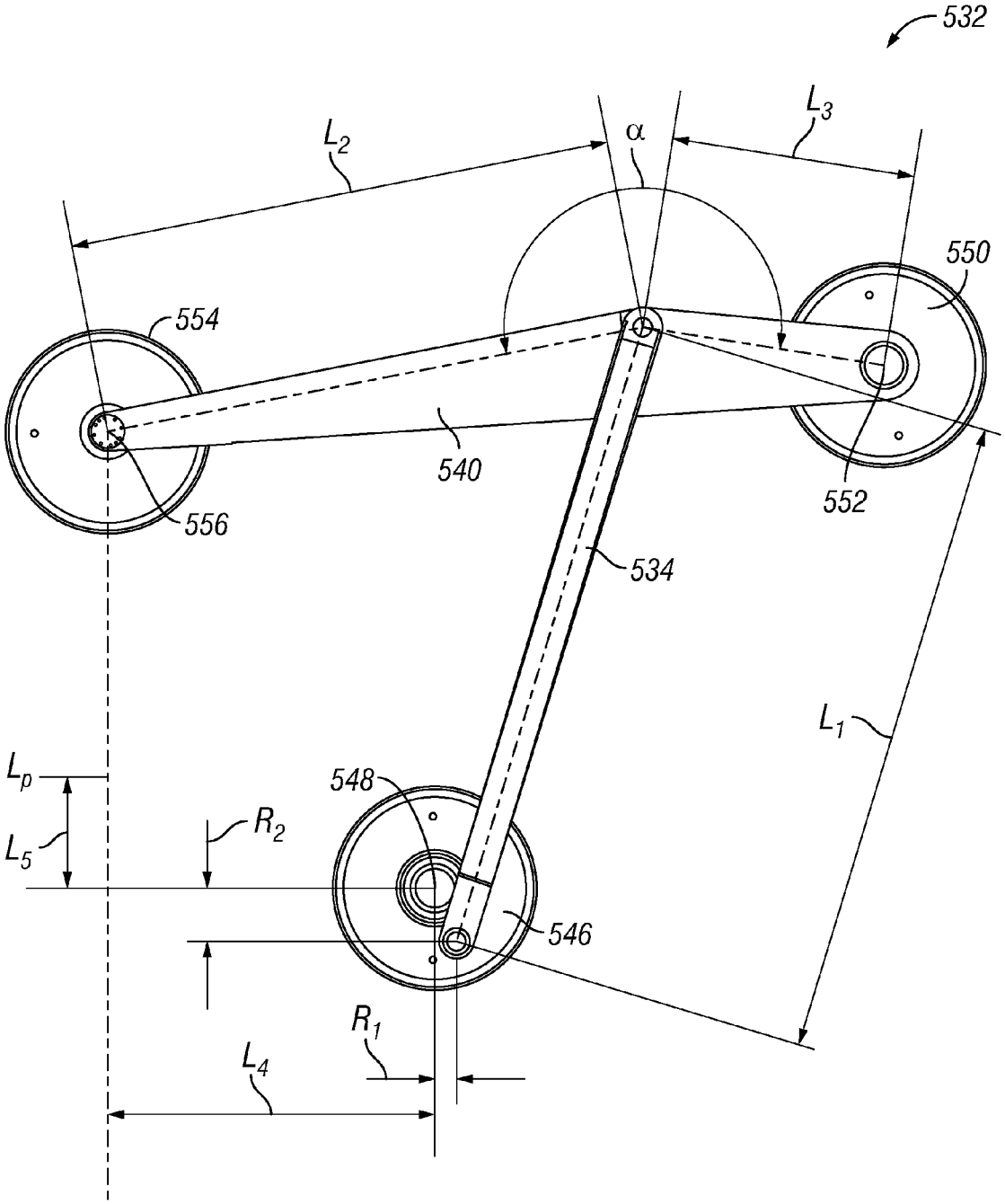
FIG. 5 shows a rocker arm subassembly of a motion compensation system in accordance with one or more embodiments of the present disclosure.

Referring now to FIG. 5, a rocker arm subassembly 532 of a motion compensation system in accordance with one or more embodiments of the present disclosure is shown. The rocker arm subassembly 532 may include one or more parameters, such as described below, that may be varied, depending on the desired features and/or desired effects when using a motion compensation system in accordance with the present disclosure. For example, a first length $L_1$ may be defined as the length between the connection point of the first arm 534 with the structure and the connection point of the first arm 534 with the second arm 540. A second length $L_2$ may be defined as the length between the connection point of the second arm 540 with the third sheave 554, such as the axis 556 of the third sheave 554, and the connection point of the first arm 534 with the second arm 540. A third length $L_3$ may be defined as the length between the connection point of the first arm 534 with the second arm 540 and the connection point of the second arm 540 with the second sheave 550, such as the axis 552 of the second sheave 550. An angle $\alpha$ may then be defined as the angle formed between the second length $L_2$ and the third length $L_3$.

A fourth length $L_4$ may be defined as the horizontal distance, or the distance along the x-axis as defined with respect to the legend, between the axis 548 of the first sheave 546 and the axis 556 of the third sheave 554. A fifth length $L_5$ may be defined as the vertical distance, or the distance along the y-axis as defined with respect to the legend, between the axis 548 of the first sheave 546 and the axis 556 of the third sheave 554 when the third sheave 554 is in the lower position $L_p$. A first radius $R_1$ may be defined as the horizontal distance, or the distance along the x-axis as defined with respect to the legend, between the axis 548 of the first sheave 546 and the connection point of the first arm 534 with the structure. Further, a second radius $R_2$ may be defined as the vertical distance, or the distance along the y-axis as defined with respect to the legend, between the axis 548 of the first sheave 546 and the connection point of the first arm 534 with the structure.

As such, one or more of the above defined parameters, in addition to any other parameters, may be varied, depending on the desired features and/or desired effects when using the rocker arm subassembly 532 within a motion compensation system in accordance with the present disclosure. For example, as shown in FIG. 5, the angle $\alpha$ may be greater than about 180 degrees, such as by having the angle $\alpha$ formed between about 196 degrees to about 204 degrees. However, those having ordinary skill in the art will appreciate that the angle $\alpha$ may be less than about 180 degrees. In one or more embodiments, a motion compensation system having a rocker arm subassembly with an angle $\alpha$ greater than about 180 degrees may be used to reduce the force variation applied to a load, such as applied to a drill string and/or drill bit, when compensating for motion. Further, in one or more embodiments, a motion compensation system having a rocker arm subassembly with an angle $\alpha$ less than about 180 degrees may be used to reduce variation of the relative distance of the cable between the crown block (e.g., crown block 102 in FIG. 1) and the traveling block (e.g., traveling block 120 in FIG. 1) when compensating for motion.

Those having ordinary skill in the art will appreciate that the present disclosure is not limited to only the above shown embodiments, as the present disclosure also contemplates other embodiments and configurations, in addition to those shown above. For example, as shown in FIG. 5, the first arm 534 may be connected to the second arm 540 between the second sheave 550 and the third sheave 554. In particular, the connection point of the first arm 534 with the second arm 540 may be between the connection point of the second arm 540 with the second sheave 550 and the connection point of the second arm 540 with the third sheave 554. However, alternatively, in one or more embodiments, the second sheave 550 may be connected to the second arm 540 between the first arm 534 and the third sheave 554. In particular, the connection point of the second sheave 550 with the second arm 540 may be between the connection point of the first arm 534 with the second arm 540 and the connection point of the second arm 540 with the third sheave 554. As such, the present disclosure contemplates alternative embodiments, in addition to those shown and discussed above.

Figure 6:
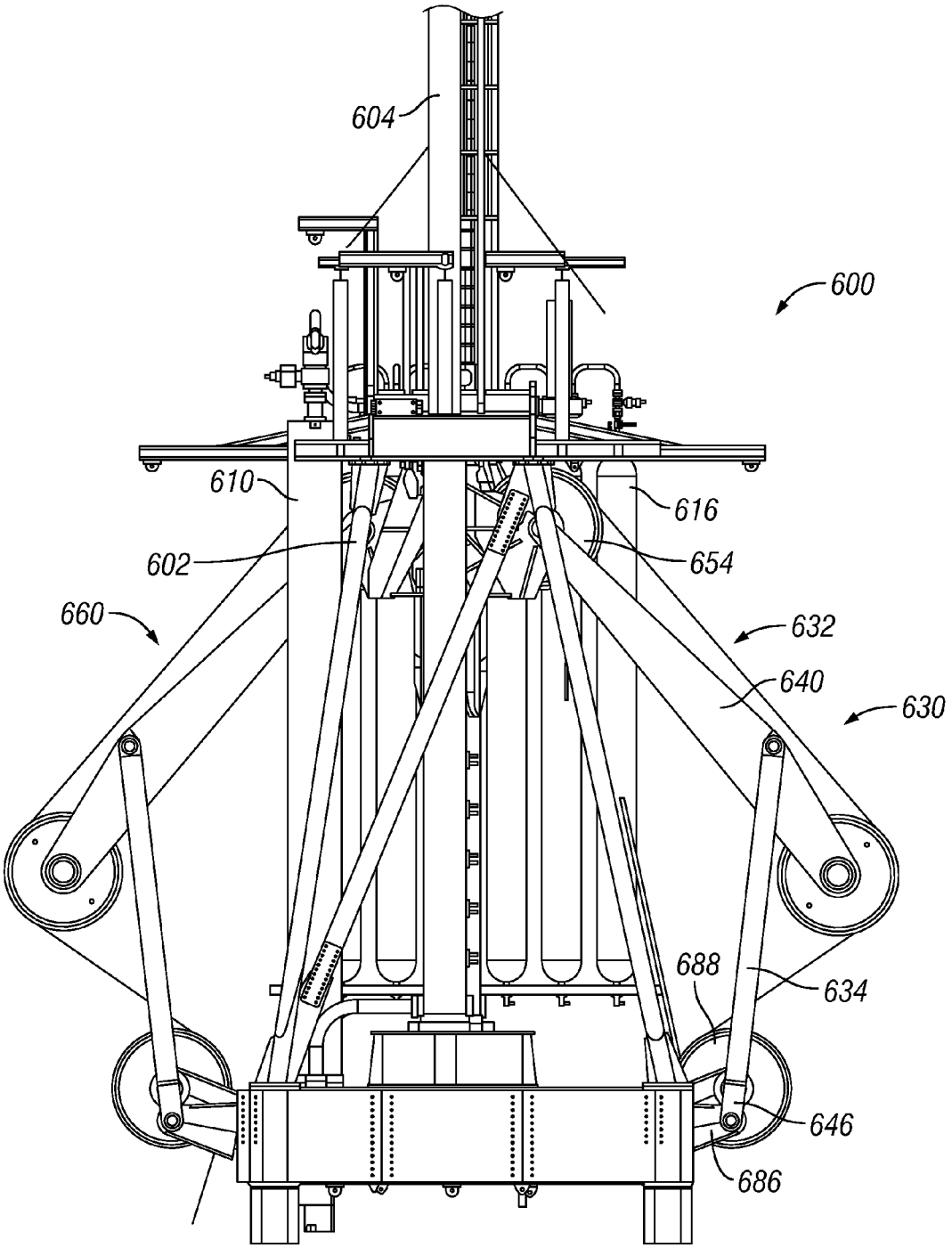
FIGS. 6-8 show a motion compensation system at multiple positions in accordance with one or more embodiments of the present disclosure.
Figure 7:
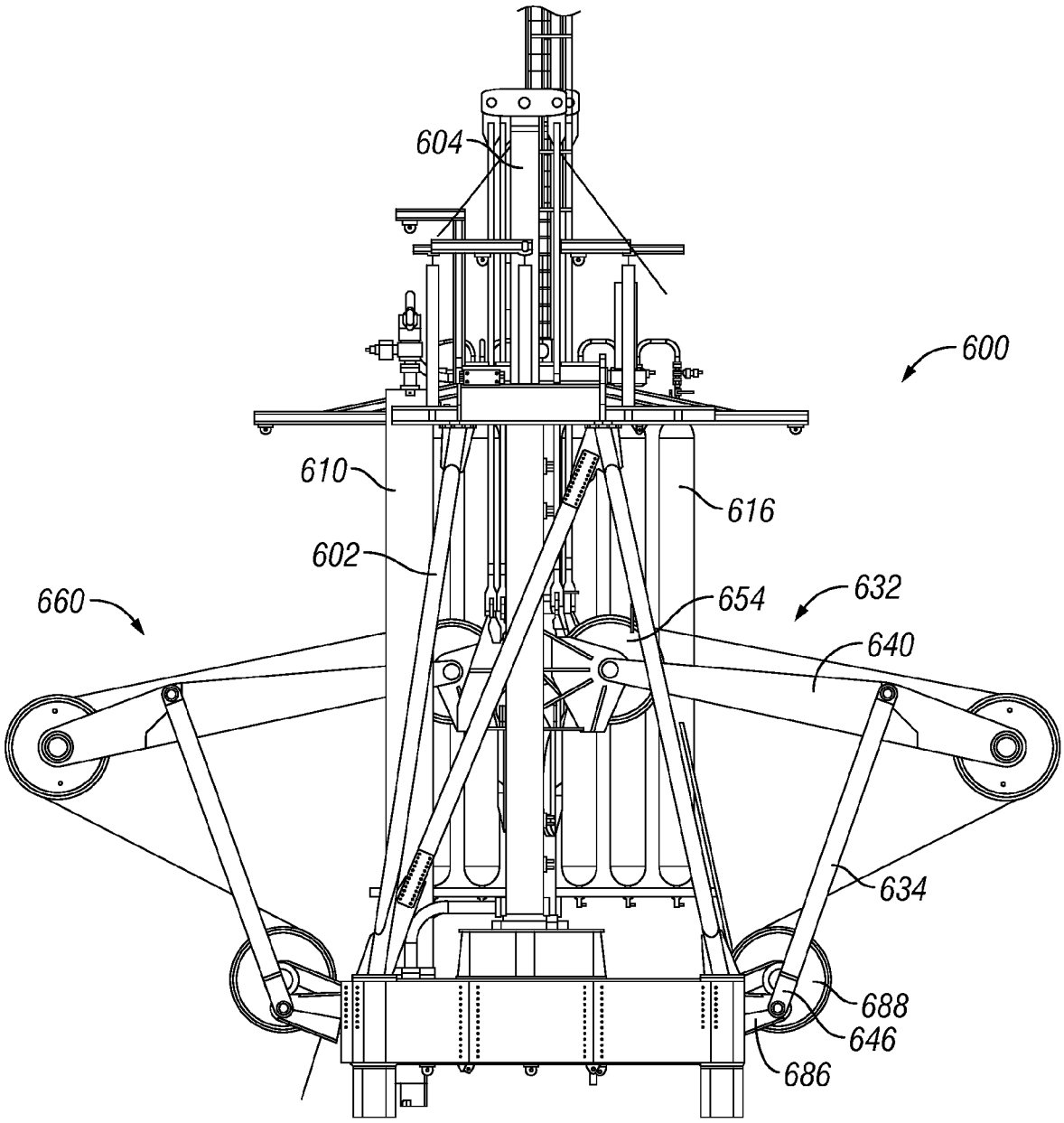
Figure 8:
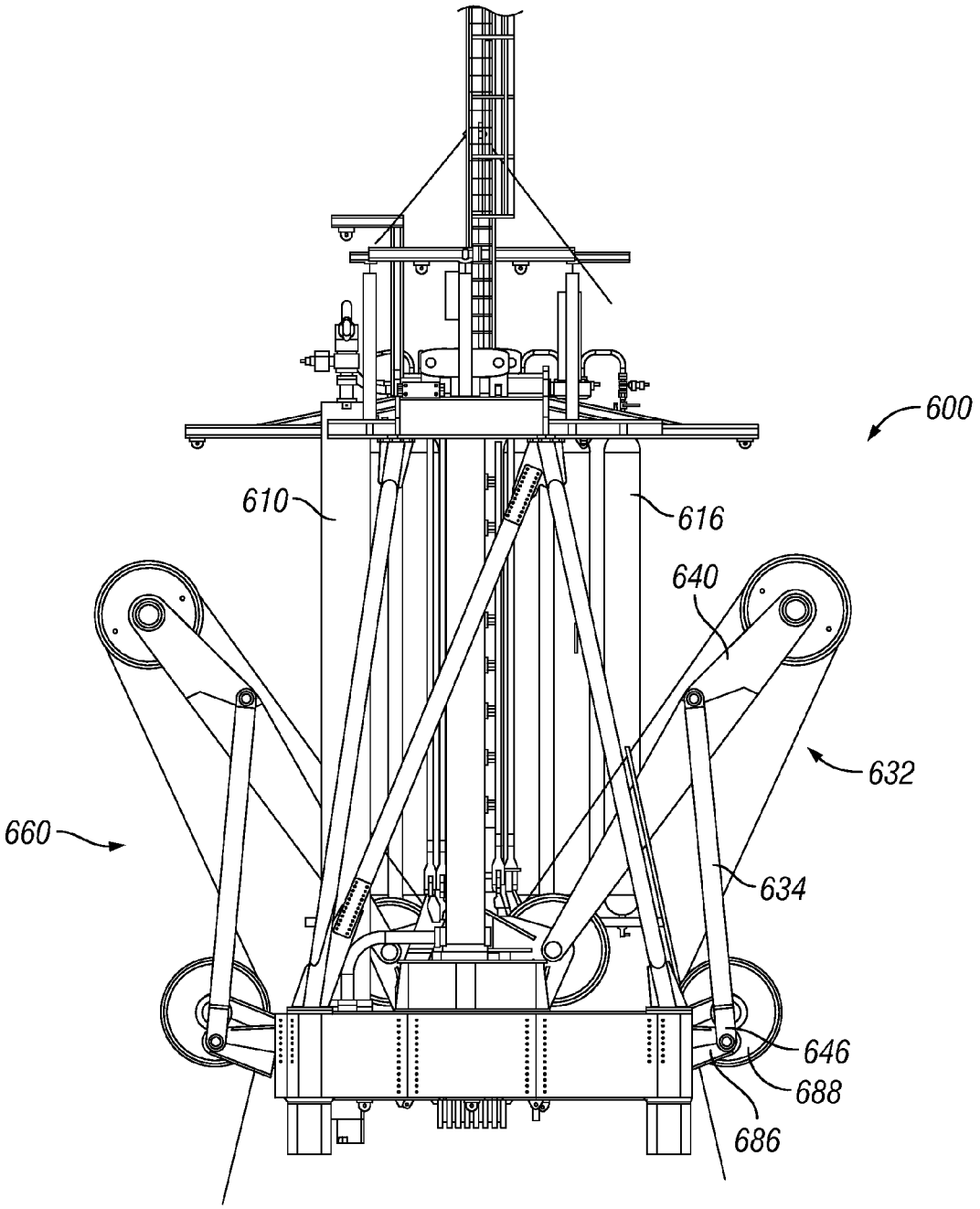

Referring now to FIGS. 6-8, a motion compensation system 600 in accordance with one or more embodiments of the present disclosure is shown. In particular, the motion compensation system 600 is shown in the upper position $U_p$ in FIG. 6, in the intermediate position $I_p$ in FIG. 7, and the lower position $L_p$ in FIG. 8, in which the stabilization assembly 630 including the rocker arm subassembly 632 and/or the rocker arm subassembly 660 may move with the crown block 602 between these positions. As the crown block 602 and the stabilization assembly 630 move from the upper position $U_p$ in FIG. 6 to in the intermediate position $I_p$ in FIG. 7, and then to the lower position $L_p$ in FIG. 8, this movement may exert pressure on fluid (e.g., liquid) contained within the compensator cylinders 604 such that fluid may move from the compensator cylinders 604 to the accumulator 610 fluidly coupled thereto.

As fluid passes into the accumulator 610 from the compensator cylinders 604, this movement may exert pressure on fluid (e.g., gas) contained within the accumulator 610. Fluid may then pass from the accumulator 610 to the chambers 616 (e.g., air pressure vessels), in which the chambers 616 may be used to provide a low frequency dampening effect as the crown block 602 moves. As such, as the crown block 602 moves between the upper position $U_p$, the intermediate position $I_p$, and the lower position $L_p$, the stabilization assembly 630 may be used to reel the cable extending between the crown block 602 and a traveling block in-and-out. This arrangement may enable the traveling block, and any components coupled thereto, such as a connection device, to remain relatively stable and/or stationary to reduce any variations of load applied to a drill string and drill bit coupled to the traveling block or connection device, particularly when used in drilling operations.

As discussed above, the stabilization assembly 630 may be connected to a structure (e.g., structure 126 in FIG. 1), such as connected to a deck of a derrick disposed on a drilling vessel. Accordingly, one or more hinges may be used to connect the stabilization assembly 630 to the structure, and in particular rotatably connect one or more components of the stabilization assembly 630 to the structure. For example, as shown in FIGS. 6-8, a first hinge 686 may be used to rotatably connect the first arm 634 of the rocker arm subassembly 632 to the structure, and a second hinge 688 may be used to rotatably connect the first sheave 646 of the rocker arm subassembly 632 to the structure. A first hinge 686 and a second hinge 688 are shown in FIGS. 6-8, though one having ordinary skill in the art will appreciate that only a single hinge may be used in other embodiments. Further, similar hinges may be used when connecting the third sheave 654 to the crown block 602 and/or when connecting components of the rocker arm subassembly 660 within the motion compensation system 600 or to the structure.

Further, as discussed above, one or more components may be rotatably connected to each other within the present disclosure. As such, one or more pins and/or bearings may be used to rotatably connect multiple components to each other. For example, with reference to FIGS. 6-8, a pin and bearing may be used to rotatably connect the first arm 634 to the second arm 640 within the rocker arm subassembly 630.

Although the present invention has been described with respect to specific details, it is not intended that such details should be regarded as limitations on the scope of the invention, except to the extent that they are included in the accompanying claims.

What is claimed is:

1. A stabilization assembly for use within a motion compensation system disposed on a structure of a drilling vessel, comprising:

a first arm directly connectable to the structure;

a second arm connectable to the first arm;

a first sheave connectable to the second arm;

a second sheave connectable to the second arm; and wherein the first arm, the first sheave, and the second sheave are each rotatably connected about an axis to the second arm, with each axis of the first arm, the first sheave, and the second sheave offset from and fixed with respect to each other.

2. The stabilization assembly of claim 1, wherein the first arm comprises a first end and a second end, the first end is connectable to the structure, and the second end is connectable to the second arm.

3. The stabilization assembly of claim 1, further comprising a third sheave connectable to the structure.

4. The stabilization assembly of claim 1, wherein the second arm comprises a first end and a second end, the first end is connectable to the first sheave, and the second end is connectable to the second sheave.

5. The stabilization assembly of claim 1, wherein the first arm is connectable to the second arm between the first sheave and the second sheave.

6. The stabilization assembly of claim 1, wherein the first arm is rotatably connectable to the structure.

7. A stabilization assembly for use within a motion compensation system disposed on a structure of a drilling vessel, comprising:

a first arm connectable to the structure;

a second arm connectable to the first area;

a first sheave connectable to the second arm;

a second sheave connectable to the second arm;

a third arm connectable to the structure;

a fourth arm connectable to the third arm;

a third sheave connectable to the fourth arm;

a fourth sheave connectable to the fourth arm;

wherein the first arm, the first sheave, and the second sheave are each rotatably connected about an axis to the second arm, with each axis of the first arm, the first sheave, and the second sheave offset from and fixed with respect to each other; and wherein the third arm, the third sheave, and the fourth sheave are each rotatably connected about an axis to the fourth arm, with each axis of the third arm, the third sheave, and the fourth sheave offset from and fixed with respect to each other.

8. The stabilization assembly of claim 3, wherein the first arm and the third sheave are rotatably connectable to the structure about different axes.

9. The stabilization assembly of claim 1, wherein the second arm is movable between an upper position and a lower position with respect to the first arm, and a cable is engageable with and extendable between the first sheave and the second sheave.

10. A motion compensation system disposed on a structure of a drilling vessel, the system comprising:

a crown block;

a stabilization assembly connectable between the crown block and the structure, the stabilization assembly comprising:

a first arm directly connectable to the structure;

a second arm connectable to the first arm;

a first sheave connectable to the second arm;

a second sheave connectable to the second arm; and wherein the first arm, the first sheave, and the second sheave are each rotatably connected about an axis to the second arm, with each axis of the first arm, the first sheave, and the second sheave offset from and fixed with respect to each other;

a cable extendable from the crown block and between the first sheave and the second sheave; and wherein the stabilization assembly is movable with the crown block between an upper position and a lower position with respect to the structure.

11. The system of claim 10, wherein the structure comprises a derrick, and the first arm is connectable to a deck of the derrick.

12. The system of claim 10, wherein the first arm comprises a first end and a second end, the first end is connectable to the structure, and the second end is connectable to the second arm.

13. The system of claim 10, wherein the stabilization assembly further comprises:

a third sheave connectable to the structure.

14. The system of claim 13, wherein the second arm comprises a first end and a second end, the first end is connectable to the first sheave, and the second end is connectable to the second sheave.

15. The system of claim 13, wherein the first arm is connectable to the second arm between the first sheave and the second sheave.

16. The system of claim 10, wherein the first arm is rotatably connectable to the structure.

17. The system of claim 10, wherein the stabilization assembly further comprises:

a third arm connectable to the structure;

a fourth arm connectable to the third arm;

a third sheave connectable to the fourth arm; and a fourth sheave connectable to the fourth arm;

wherein the third arm, the third sheave, and the fourth sheave are each rotatably connected about an axis to the fourth arm, with each axis of the third arm, the third sheave, and the fourth sheave offset from and fixed with respect to each other; and wherein the cable is extendable from the crown block and between the third sheave and the fourth sheave.

18. The system of claim 13, wherein the first arm and the third sheave are rotatably connectable to the structure about different axes.

* * * * *